US007407130B2

(12) United States Patent
Shimamura

(10) Patent No.: US 7,407,130 B2
(45) Date of Patent: Aug. 5, 2008

(54) PAPER MAGAZINE

(75) Inventor: Yasunobu Shimamura, Wakayama-ken (JP)

(73) Assignee: Noritsu Koki, Co., Ltd., Wakayama-shi (JP)

( * ) Notice: Subject to any disclaimer, the term of this patent is extended or adjusted under 35 U.S.C. 154(b) by 229 days.

(21) Appl. No.: 11/154,390

(22) Filed: Jun. 16, 2005

(65) Prior Publication Data

US 2005/0284974 A1 Dec. 29, 2005

(30) Foreign Application Priority Data

Jun. 16, 2004 (JP) ..... 2004-178257

(51) Int. Cl.
*B65H 23/00* (2006.01)

(52) U.S. Cl. ..... 242/566

(58) Field of Classification Search ..... 242/354.2, 242/397, 548, 566, 615, 348, 348.3, 348.4, 242/354, 564.4

See application file for complete search history.

(56) References Cited

U.S. PATENT DOCUMENTS 3,341,146 A * 9/1967 Fairbanks et al. ..... 242/410
3,645,434 A * 2/1972 Rab ..... 242/348.4
4,928,897 A * 5/1990 Satou et al. ..... 242/564.4
4,981,380 A * 1/1991 Nishida et al. ..... 400/619
5,797,560 A * 8/1998 Kishi et al. ..... 242/528

FOREIGN PATENT DOCUMENTS

| | | |
|---|---|---|
| JP | 2001-092031 | 4/2001 |
| JP | 2001-130790 | 5/2001 |
| JP | 2002-087650 | 3/2002 |
| JP | 2002-250991 | 9/2002 |
| JP | 2002-296693 | 10/2002 |

* cited by examiner

*Primary Examiner*—Peter M. Cuomo
*Assistant Examiner*—William E Dondero
(74) *Attorney, Agent, or Firm*—Fulbright & Jaworski LLP

(57) ABSTRACT

A paper magazine includes a shaft portion for rotatably supporting a paper roll inside a box-like frame, a paper transporting system configured for pinching a paper drawn out of the paper roll supported on the shaft portion by transport rollers and delivering this paper through an opening formed in the frame, and a transmission mechanism for effecting the delivery and rewinding of the paper through the opening by transmitting a forward drive force and a reverse drive force to the transport rollers. A guide member is provided on an inner wall face of the frame disposed at a lower portion inside the paper magazine. The guide member is configured for coming into contact with a terminal end of the paper delivered from the paper magazine which end assumes a hanging-down posture as a result of a paper rewinding operation effected after detachment of the terminal end from said shaft portion as a result of a paper delivering operation effected with the paper magazine being set under a predetermined posture.

5 Claims, 12 Drawing Sheets

PAPER MAGAZINE

This application claims priority from Japanese Patent Application No. JP 2004-178257 filed Jun. 16, 2004, incorporated by reference in its entirety.

BACKGROUND OF THE INVENTION

1. Field of the Invention

The present invention relates to a paper magazine having a shaft portion for rotatably supporting a paper roll inside a box-like frame, a paper transporting system configured for pinching a paper drawn out of the paper roll supported on the shaft portion by transport rollers and delivering this paper through an opening formed in the frame, and a transmission mechanism for effecting the delivery and rewinding of the paper through the opening by transmitting a forward drive force and a reverse drive force to the transport rollers and the shaft portion, respectively.

2. Description of the Related Art

As a technique relating to the paper magazine having the above-described construction, paper magazines are known from Japanese Patent Application "Kokai" No. 2002-87650 (paragraphs 0011 through 0022, FIGS. 2-6) and Japanese Patent Application "Kokai" No. 2001-92031 (paragraphs 0023 through 0046, FIGS. 1-3).

The paper magazine disclosed in the former gazette includes a support shaft for supporting a print paper in the form of a roll, a pair of rollers for pinching a portion of the print paper drawn out of the print paper roll and delivering this paper portion through an opening, and a gear transmission system for operably coupling the pair of rollers with the support shaft. In operation, in association with forward rotations of the rollers and the support shaft via the transmission system, the print paper is delivered from the magazine, whereas in association with reverse rotations of the rollers and the support shaft via the system, the print paper is rewound into the magazine.

In the case of the paper magazine disclosed by the latter gazette, a core of a paper roll is supported inside the paper magazine for effecting delivery and rewinding of the paper. More particularly, a delivery roller and a rewinding roller are disposed in a paper clamping relationship with each other. And, a second driver roller rotatable in operative association with the rewinding roller is disposed to be pressed against an outer face of the paper roll. For delivering the paper, the delivering roller is driven in the forward direction, whereby the paper clamped between this forward rotated delivering roller and the rewinding roller is paid out through a paper exit. On the other hand, for rewinding the paper, the rewinding roller is driven in the reverse direction, whereby the paper clamped between the delivering roller and this reversely rotated rewinding roller is rewound through the paper exit and at the same time, the second drive roller is caused to apply a rewinding force to the outer periphery of the paper roll. Further, this document discloses also a photographic processing apparatus including two paper magazines each having the above-described construction, with these magazines being supported on a magazine mount under a posture orienting the paper exit downwardly and a further posture orienting the exit laterally. This photographic processing apparatus is configured to effect exposure, at an image forming section, on a paper delivered from one of the magazines.

As described in the latter gazette, with this type of photographic processing apparatus, paper delivered from the paper magazine is cut to a print size by a cutter and then the exposure operation is effected thereon. Therefore, if the paper once delivered from the paper magazine is to be rewound back into the paper magazine, this rewinding operation is to be effected on the paper having a length same as a distance from the position of the paper magazine to the cutter. When such rewinding operation is to be effected after the terminal end of the paper has been detached from the core of the paper roll, the conventional paper magazines do not take into consideration guiding of the terminal end of the paper during the rewinding operation. Hence, if the rewinding operation is effected after detachment of the terminal end of the paper from the paper roll core, this rewinding operation cannot proceed smoothly as the terminal end of the paper contacts with e.g. a projecting portion inside the paper magazine or the terminal end of the paper may be bent inadvertently.

SUMMARY OF THE INVENTION

In view of the above, a primary object of the present invention is to provide a paper magazine capable of effecting a smooth rewinding operation regardless of the posture of the terminal end of the paper after its detachment from the paper roll core.

For accomplishing the above-noted object, a paper magazine, according to the present invention comprises:

a shaft portion for rotatably supporting a paper roll inside a box-like frame;

a paper transporting system configured for pinching a paper drawn out of the paper roll supported on the shaft portion by transport rollers and delivering this paper through an opening formed in the frame;

a transmission mechanism for effecting the delivery and rewinding of the paper through the opening by transmitting a forward drive force and a reverse drive force to the transport rollers; and a guide member provided on an inner wall face of the frame disposed at a lower portion inside the paper magazine, said guide member being configured for coming into contact with a terminal end of the paper delivered from the paper magazine which end assumes a hanging-down posture as a result of a paper rewinding operation effected after detachment of the terminal end from said shaft portion as a result of a paper delivering operation effected with the paper magazine being set under a predetermined posture.

According to the above-described construction, with the paper magazine being set under the predetermined posture, the transport rollers are driven in the forward direction to deliver the paper. Then, if a rewinding operation of the paper is subsequently effected after the terminal end of the paper has been detached from the shaft portion (e.g. a roll core) of the paper roll as the result of the above delivering operation, the guide member comes into contact with the terminal end of the paper assuming the hanging-down posture as the result of the detachment and the guide member guides this terminal end in the rewinding direction. As a result, there will occur no bending or damage of the paper, so that the entire paper roll until its terminal end can be used in good condition by delivering its paper even after the above-described rewinding operation.

Preferably, said predetermined posture includes at least one of a posture for delivering the paper through the opening in a horizontal direction and a posture for delivering the paper through the opening in a perpendicularly downward direction.

With this construction, the paper magazine can deliver the paper smoothly either under the posture for delivering the paper through the opening in a horizontal direction or the posture for delivering the paper through the opening in a perpendicularly downward direction.

Said guide member can be provided as a member formed inside the frame and having a guide face which is substantially circular about an axis of said shaft portion as seen along this axis.

With this construction, whether the magazine is set under the posture for delivering the paper through the opening in the horizontal direction or the posture for delivering the paper through the opening in the perpendicularly downward direction, when the paper is rewound, the terminal end of the paper always comes into contact with the guide member. Hence, this construction assures reliable guiding.

Further, said guide member can be formed as a plurality of ribs formed integral with the inner wall face of the frame and oriented substantially normal to a surface of the paper.

With this construction, the guide member need not be formed by increasing the thickness of the wall of the paper magazine which has a rectangular shape as seen along the axis of the shaft portion. Instead, the terminal end of the paper can be guided by the guide member provided in the form of a plurality of ribs. Accordingly, it become also possible to increase the strength of the frame while restricting increase of its weight.

Said guide member can include an inclined portion for coming into contact with and applying a force to said terminal end of the paper in a direction toward said shaft portion during the paper rewinding operation.

With this construction, when the terminal end of the paper comes into contact with the inclined portion of the guide member, this terminal end is subjected to a component force applied from the inclined portion in the direction toward the shaft portion, so that the terminal end can be displaced away from the inner wall of the paper magazine.

Preferably, said guide member comprises two guide frame members connected to be pivotally opened/closed about a support shaft disposed parallel with an axis of said shaft portion, said guide member is disposed at a portion where said two members are adjacent each other, wherein a distance from said axis of the guide face of one of the guide frame member located on the downstream side when the print paper is rewound is set longer than a distance from said axis of the guide face of the other guide member located on the upstream side, thereby to form a stepped portion.

With the above construction, the guide member comprises two guide frame members connected to be pivotally opened/closed. And, a stepped portion is formed between the guide faces of the guide members at the portion where the two guide frame members are adjacent each other. With this construction, the paper rewinding operation can be effected smoothly, without the inconvenience of the terminal end of the paper being entrapped between the guide frame members.

Further and other features and advantages of the invention will become apparent upon reading following detailed description of a preferred embodiment thereof with reference to the accompanying drawings.

DESCRIPTION OF THE PREFERRED EMBODIMENT

A preferred embodiment of the invention will now be described in details with reference to the accompanying drawings.

Figure 1:
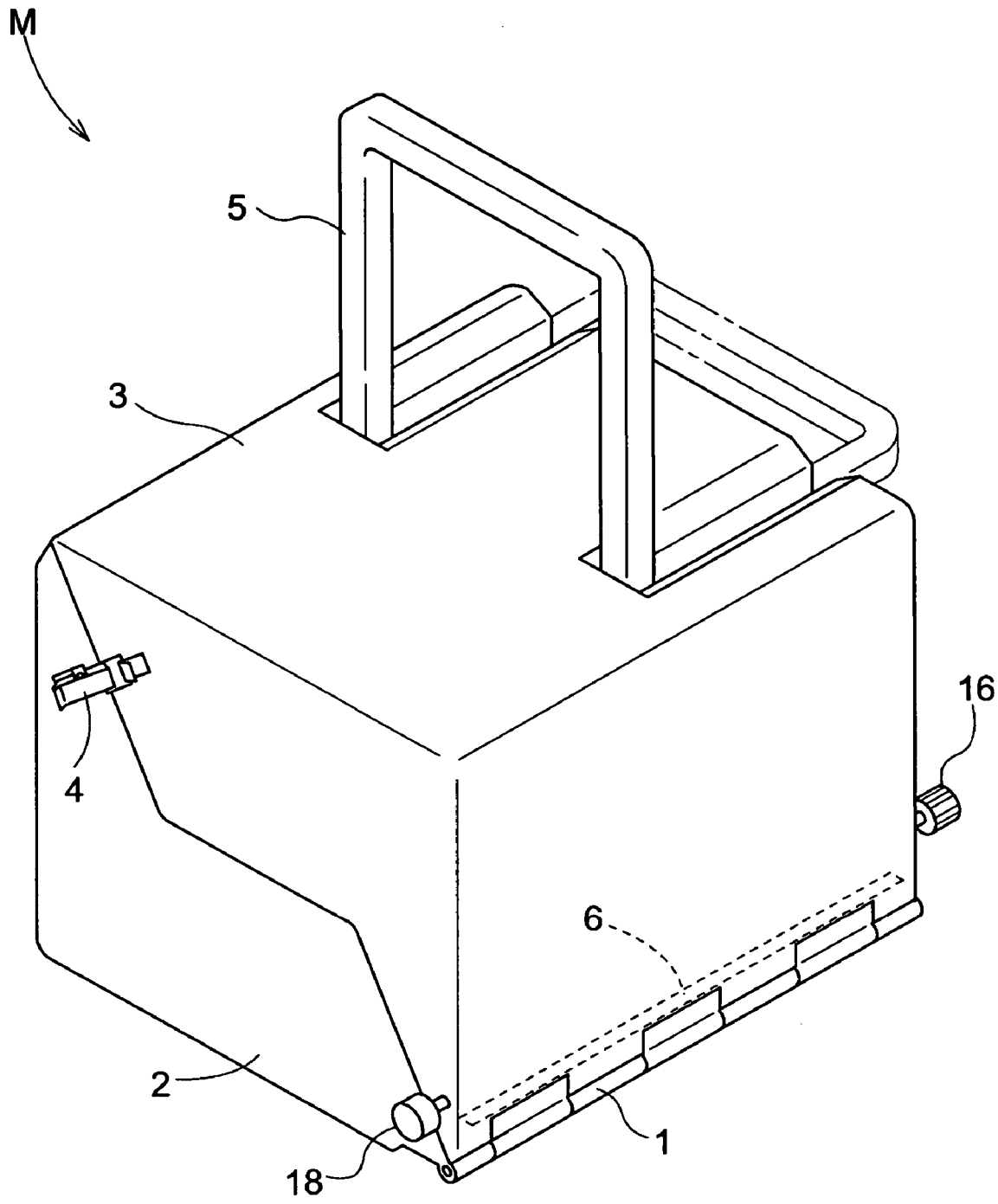
FIG. 1 is a perspective view of a paper magazine.
Figure 2:
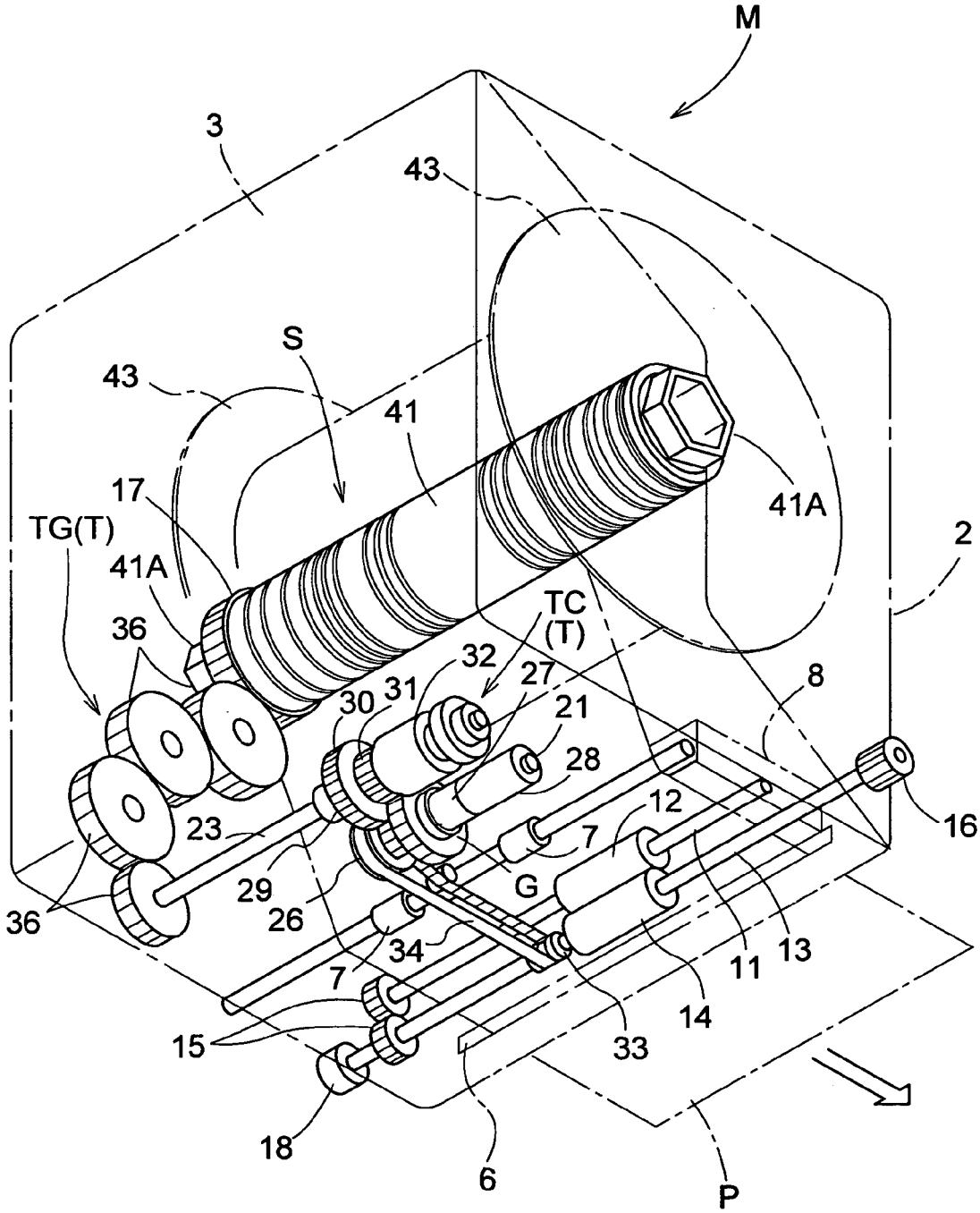
FIG. 2 is a perspective view showing principal portions of a transmission mechanism provided inside the paper magazine.
Figure 3:
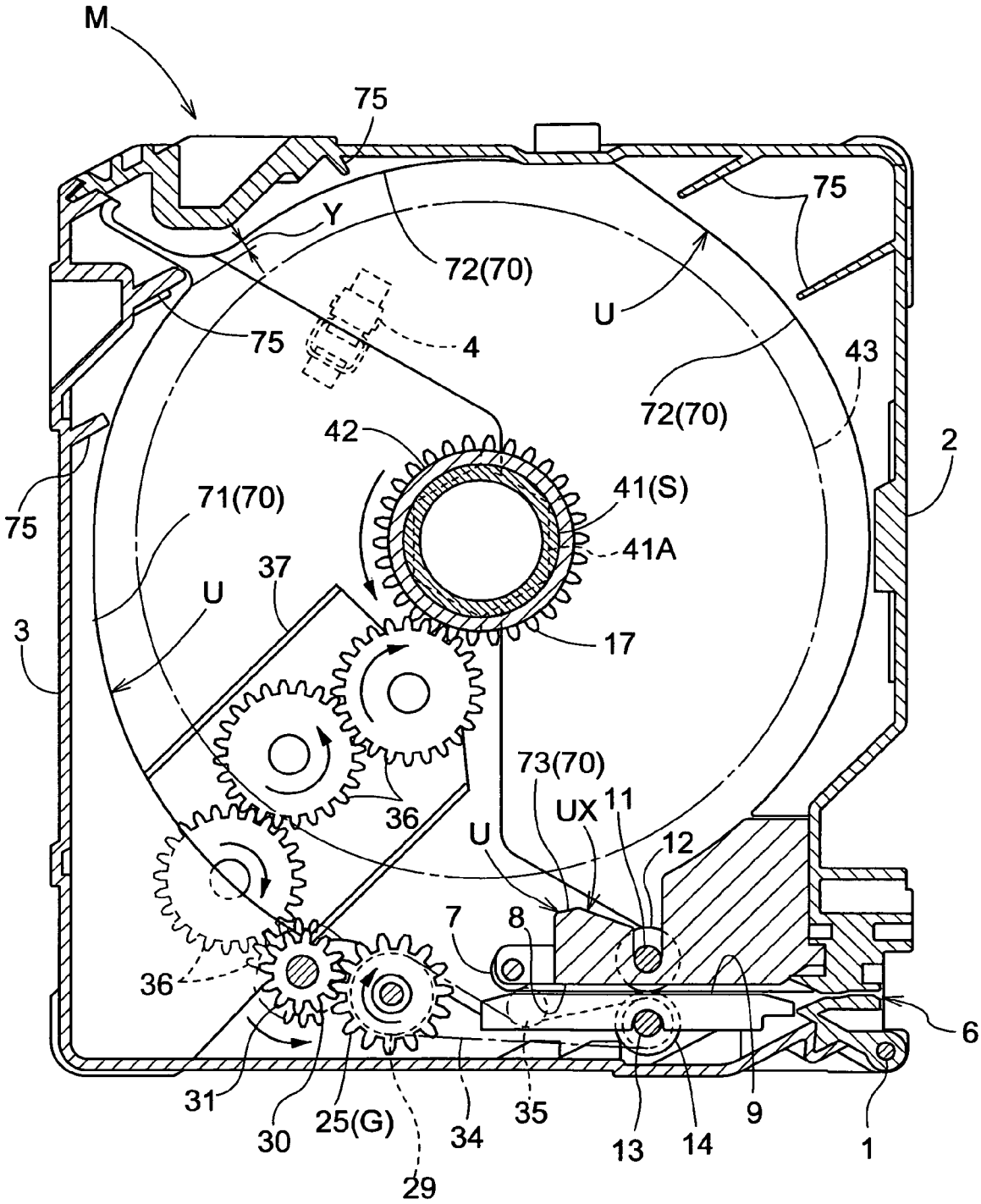
FIG. 3 is a front view in vertical section of the transmission mechanism of the paper magazine.
Figure 4:
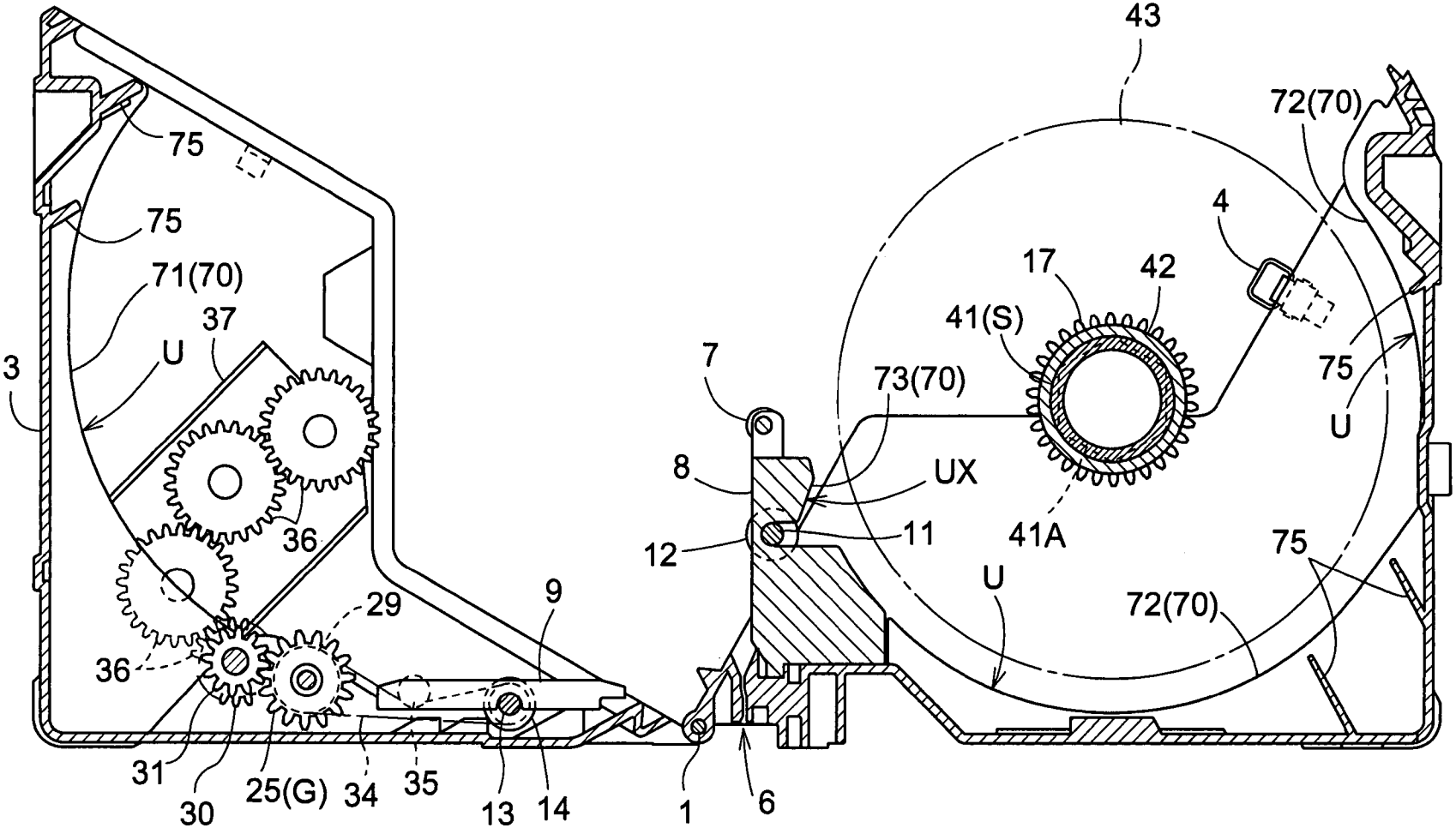
FIG. 4 is a front view in vertical section showing the paper magazine under its opened condition.

As shown in FIGS. 1 through 3, a paper magazine M includes a frame which is formed as a hexahedral body as a whole and is capable of delivering a print paper P in the form of a roll ("print paper roll") as a "paper" accommodated within the frame to the outside and rewinding the paper P into the frame. The frame is a box-like body which is rectangular as seen in the direction shown in FIG. 3. This frame comprises an assembly of a main box member 2 and an auxiliary box member 3 which are connected to each other to be pivotable about a support shaft of a hinge 1 provided at a corner of the magazine M. Hence, with a pivotal movement between the main box member 2 and the auxiliary box member 3 about the support shaft of the hinge 1, this paper magazine M can selectively assume a closed condition shown in FIG. 3 and an opened condition shown in FIG. 4 where the main and auxiliary box members 2 and 3 are opened wide away from each other. Further, with this paper magazine M, its closed condition can be maintained by a plurality of buckles 4 attached to the outer face of the magazine M. Under this closed condition, entry of light into the magazine is prevented. Whereas, under the opened condition, replacement of the print paper roll P is allowed. Further, for its improved handling, the paper magazine M includes a carrying handle 5 which can be switched over between a projecting condition and a retracted condition.

Inside the frame, there is provided a shaft portion S for supporting the print paper roll S. The main box member 2 defines an opening 6 in the form of a slit for delivering the print paper P as being supported on the shaft portion S. More particularly, as shown in FIGS. 2-8, there is provided a path for guiding the print paper P supported on the shaft portion S to the opening 7 via intermediate rollers 7 mounted to the main box member 2. Of this path guiding the print paper P, a portion thereof from the intermediate rollers 7 to the opening 6 is formed as a slit-like space between a main wall face 8 of the main box member 2 and an auxiliary wall face 9 of the auxiliary box member 3. Incidentally, as illustrated in FIG. 8, the print paper roll P comprises an elongate print paper P wound about a hollow core 45 and the print paper P is stored in the magazine M with the core 45 being fitted on the shaft portion S.

In this paper magazine M, a main shaft member 11 attached to the main wall face 8 mounts a main roller 12 and an auxiliary shaft member 13 attached to the auxiliary wall face 9 mounts an auxiliary roller 14. And, when the main box member 2 and the auxiliary box member 3 are closed relative to each other, the main roller 12 and the auxiliary roller 14 come into pressed contact with each other, thereby to clamp the print paper P therebetween for transporting this paper. For this purpose, the main shaft member 11 and the auxiliary shaft member 13 mount at respective corresponding ends thereof a matching pair of synchronous gears having a same number of teeth and meshing each other under the closed condition. The auxiliary shaft member 13 further mounts a manually rotatable knob 18 on the side of the end thereof mounting the synchronizing gear 15 and mounts an input gear 16 on the other end thereof The main roller 12 and the auxiliary roller 14 together constitute transport rollers employed in this invention for clamping the paper drawn out of the print paper roll P stored within the paper magazine M and applying a transporting fore thereto. As these transport roller are driven in a forward direction, the print paper P stored in the magazine M can be delivered through the opening 6 to the outside of the magazine. Whereas, as the transport rollers are driven a reverse direction, the paper P once drawn out from the paper magazine M can be rewound back into the paper magazine M to be stored therein again.

The input gear 16 is disposed at a position exposed from the outer face of the auxiliary box member 3. This input gear 16 is meshed with a drive gear (not shown) of a photographic printer (see FIG. 12) when the paper magazine is set to this photographic printer. And, the input gear 16 receives a rotational force from the drive gear and transmits this force to the auxiliary roller 14 and the main roller 12 and transmits the force also to the shaft portion S via a transmission mechanism T provided inside the auxiliary box member 3.

The transmission mechanism T consists essentially of a transmission control section TC and a gear transmission section TG having a plurality of gears. Then, the force from the gear transmission section TG is transmitted to a ring gear 17 mounted on the shaft portion S.

Figure 7:
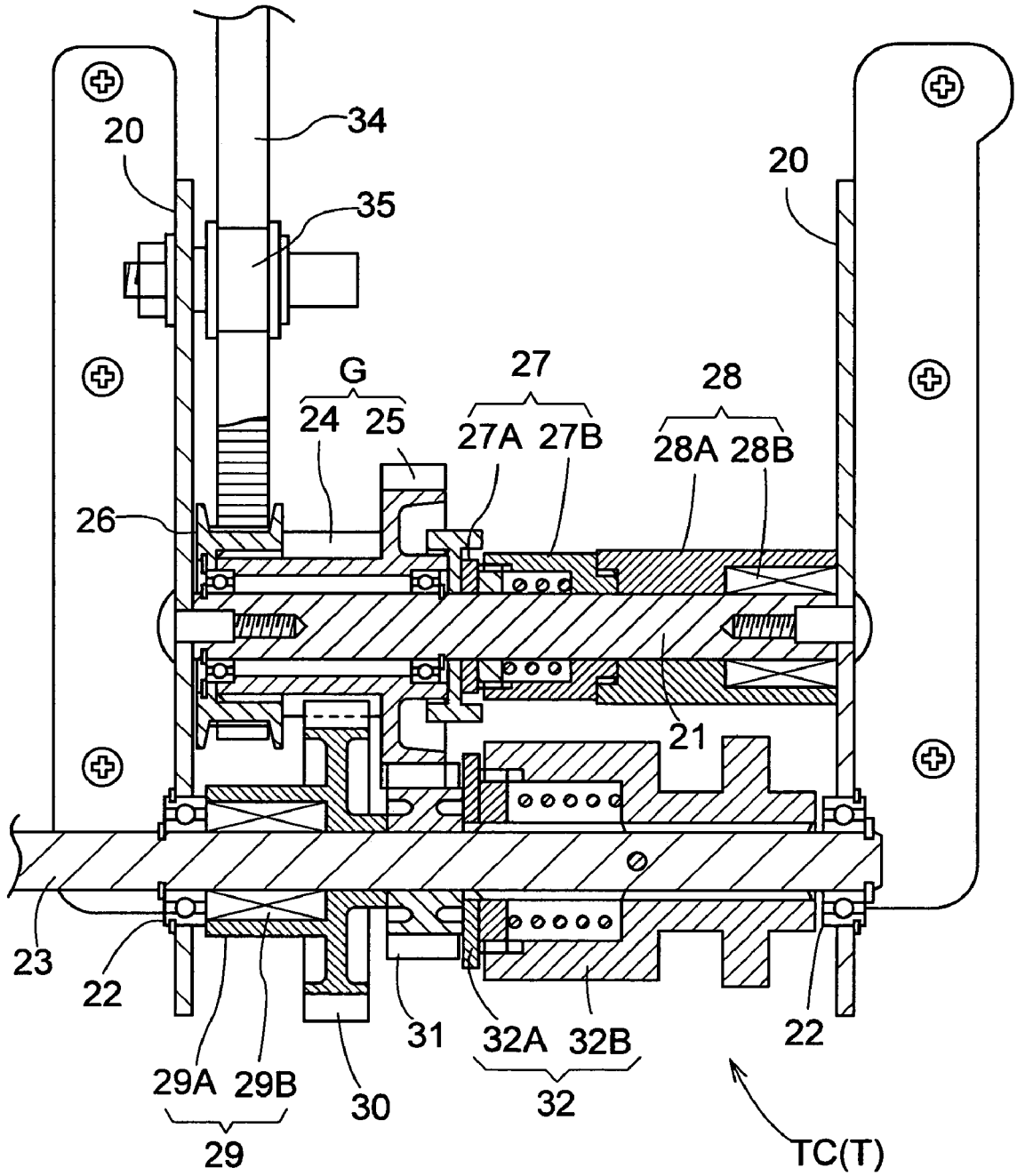
FIG. 7 is a section showing a construction of a transmission control mechanism.
Figure 8:
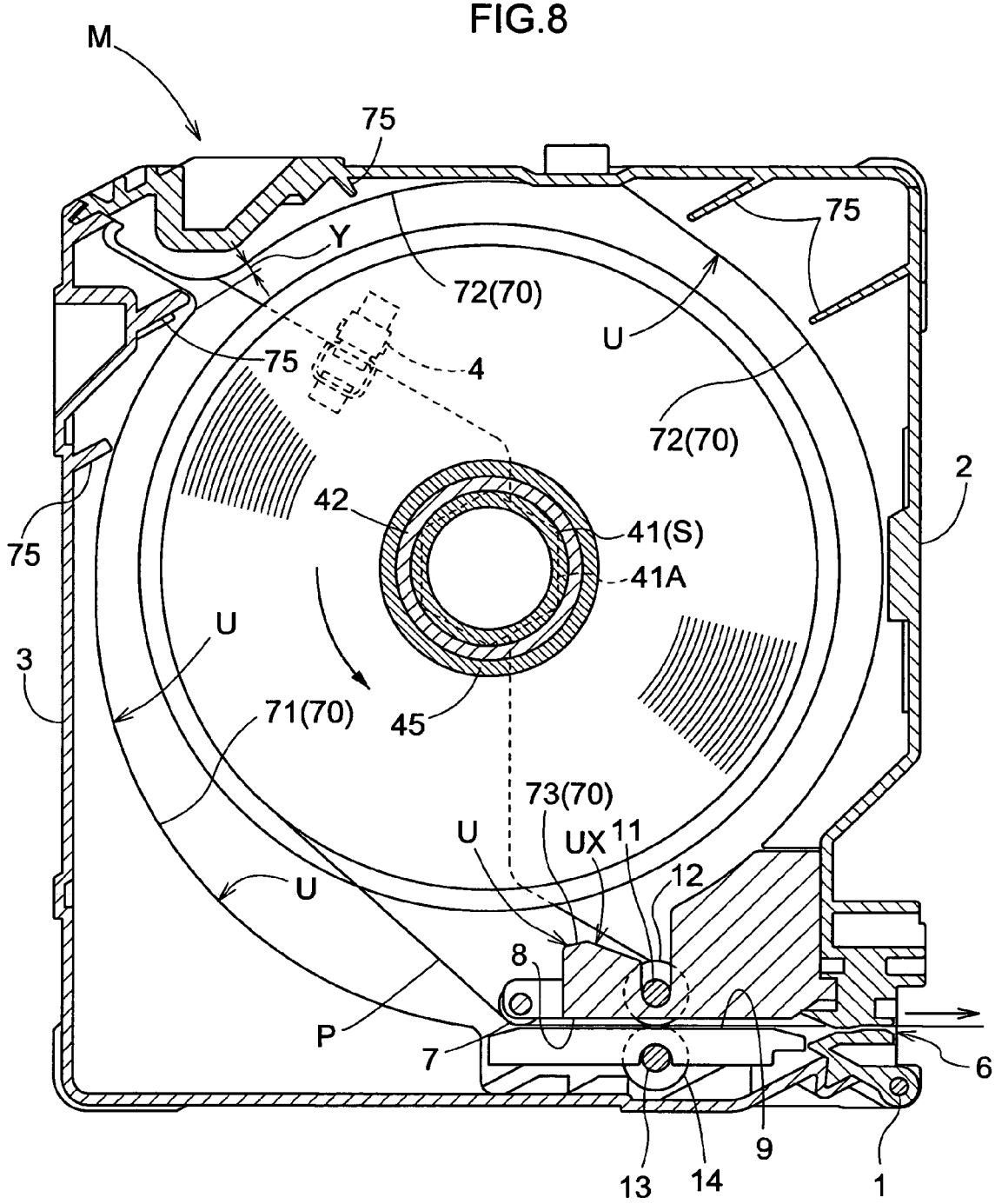
FIG. 8 is a front view in vertical section showing an inner construction of the paper magazine.

More specifically, the transmission control section TC, as shown in FIG. 7, includes a fixed shaft 21 having opposed ends thereof supported to a pair of brackets 20, and a transmission shaft 23 loosely supported to the pair of brackets 20 via bearings 22. The fixed shaft 21 mounts a gear assembly G including a small first gear 24 and a large second gear 25 formed integral with each other, an input pulley 26 rotatable in unison with the gear assembly G, a cylindrical friction applying mechanism 27 operatively coupled to the gear assembly G, and a first one-way clutch 28 rotatable in unison with the friction applying mechanism 27. The transmission shaft 23 mounts a third gear 30 having a second one-way clutch 29 and meshing with the first gear 24, a fourth gear 31 meshing with the second gear 25, and a slip transmission mechanism 32 for transmitting force with allowing slippage between the fourth gear 31 and the transmission shaft 23.

Figure 5:
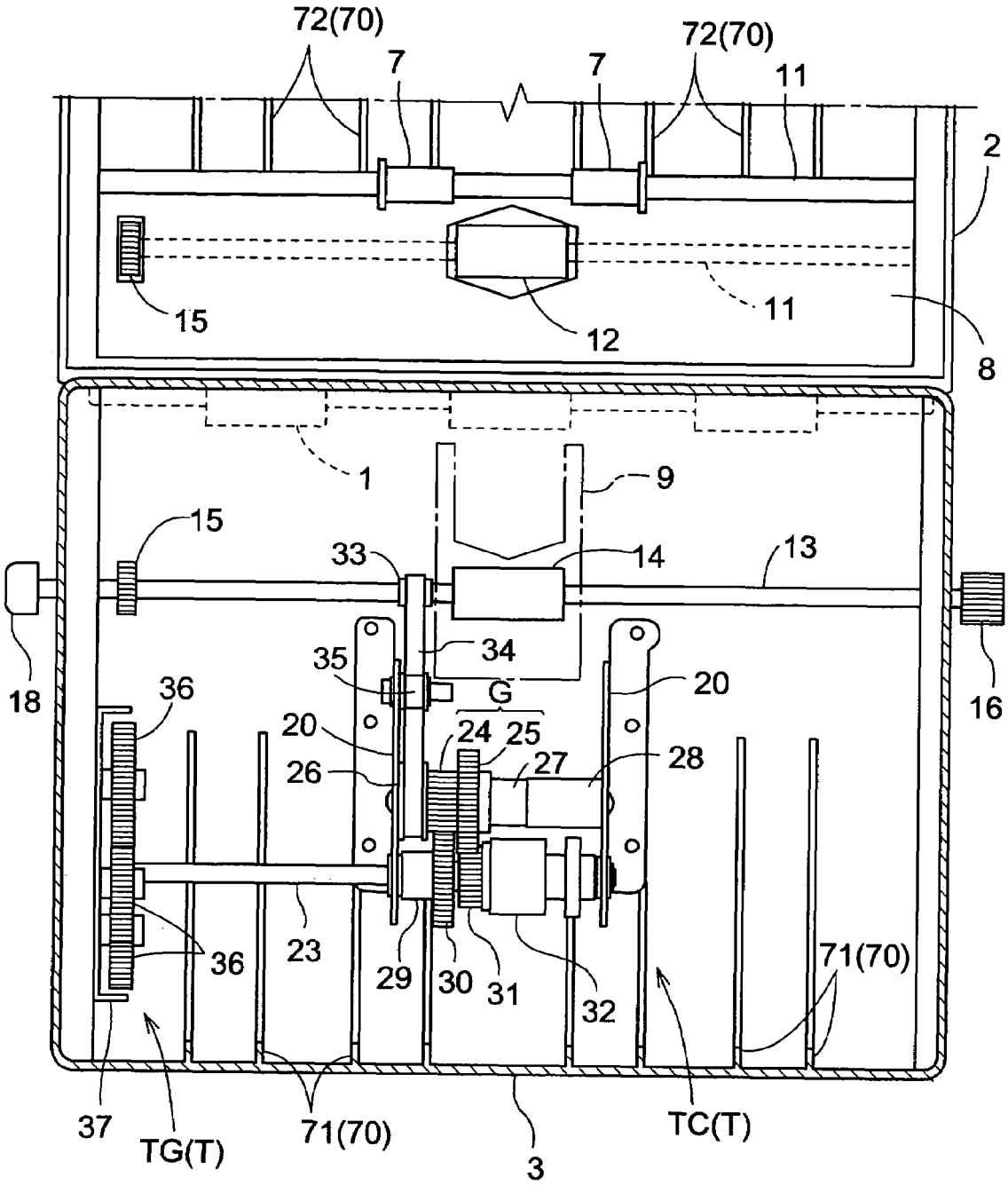
FIG. 5 shows layouts of the transmission mechanism and guides inside the paper magazine.

As shown in FIG. 2 and FIG. 5, a toothed belt 34 is entrained about an output pulley 33 mounted on the auxiliary shaft member 13 and the input pulley 26. Whereas, one bracket 20 mounts a tension pulley 35 for applying a tension to this toothed belt 34.

The friction applying mechanism 27 includes a friction plate 27A to be pressed against a lateral face (face in thrusting direction) of the gear assembly G, and a support member 27B for pressing the friction plate 27A against the lateral face of the gear assembly G by means of an urging force of a spring. The first one-way clutch 28 includes a cylindrical member 28A engaged with an end of the support member 27B and a roller type clutch body 28B interposed between the cylindrical member 28A and the fixed shaft 21. In operation, the clutch body 28B allows rotation of the gear assembly G in association with rotation of the auxiliary roller 14 in the direction for delivering the print paper P. Whereas, when the auxiliary roller 14 is rotated in the opposite direction, that is, the direction for rewinding the print paper P into the magazine, the clutch body 28B becomes constricted to the fixed shaft 21, thereby to prevent rotation of the cylindrical member 28A. When the rotation of the cylindrical member 28A is prevented as above, a braking force is applied from the friction applying mechanism 27 against rotation of the gear assembly G.

The second one-way clutch 29 includes a cylindrical member 29A formed integral with the third gear 30 and a roller type clutch body 29B housed within this cylindrical portion 29A. In operation, this second one-way clutch 29 does not transmit power to the third gear 30 when the transmission shaft 23 is rotated in the direction for delivering the print paper P. Whereas, when the gear body G is hardly rotated like the case when the print paper roll P is rotated in the direction for rewinding the paper P due to inertia or when the transmission shaft 23 is rotated in the direction for delivering the print paper with the rotation of the gear assembly B being stopped, this second one-way clutch 29 transmits the rotational force of this transmission shaft 23 to the third gear 30. And, when the transmission shaft 23 is rotated in the direction for rewinding the print paper, rotation of the first gear 24 meshed with the third gear 30 brings the first one-way clutch 28 into its rotation preventing condition, and the braking force is applied from the friction applying mechanism 27 to the transmission shaft 23, thereby to prevent rotation of this transmission shaft 23.

The slip transmission mechanism 32 includes a friction plate 32A to be pressed against a lateral face (face in the thrusting direction) of the fourth gear 31 by an urging force of a spring, and a support member 32B supported to be rotatable in unison with the transmission shaft 23 for transmitting rotational force to this transmission shaft 23 via the friction plate 32A. And, this slip transmission mechanism 32 is constructed such that a slippage occurs when a torque exceeding a predetermined threshold is applied between the fourth gear 31 and the transmission shaft 23. Further, the transmission ratio of the entire transmission system for transmitting the rotational force to the shaft portion S is set so that when the main roller 12 and the auxiliary roller 14 are rotated in the direction for delivering the print paper P, the length of the print paper portion P delivered by the main roller 12 and the auxiliary roller 14 may be longer than the print paper portion P paid out from the print paper roll P mounted on the shaft portion S. Incidentally, since the winding diameter of the print paper roll P decreases in association with paying out of the paper portion therefrom, the above-described transmission ratio is set in advance, based on a reference condition when this winding diameter of the print paper roll P is at its minimum.

And, when the rotational force for delivering the print paper P is transmitted from the second gear 25 to the fourth gear 31, the main roller 12 and the auxiliary roller 14 cooperate to pay out the print paper P from the shaft portion S and at the same time, this rotational force is transmitted from the second gear 25 to the fourth gear 31, then via the slip transmission mechanism 21 to the transmission shaft 23. Therefore, although the shaft portion S is rotated in the print paper delivering direction, the amount of this rotation of the shaft portion S is less than the amount of paying out of the print paper P by the main roller 12 and the auxiliary roller 14, so that the slip transmission mechanism 32 slips, thereby to apply a tension to the print paper P.

Figure 6:
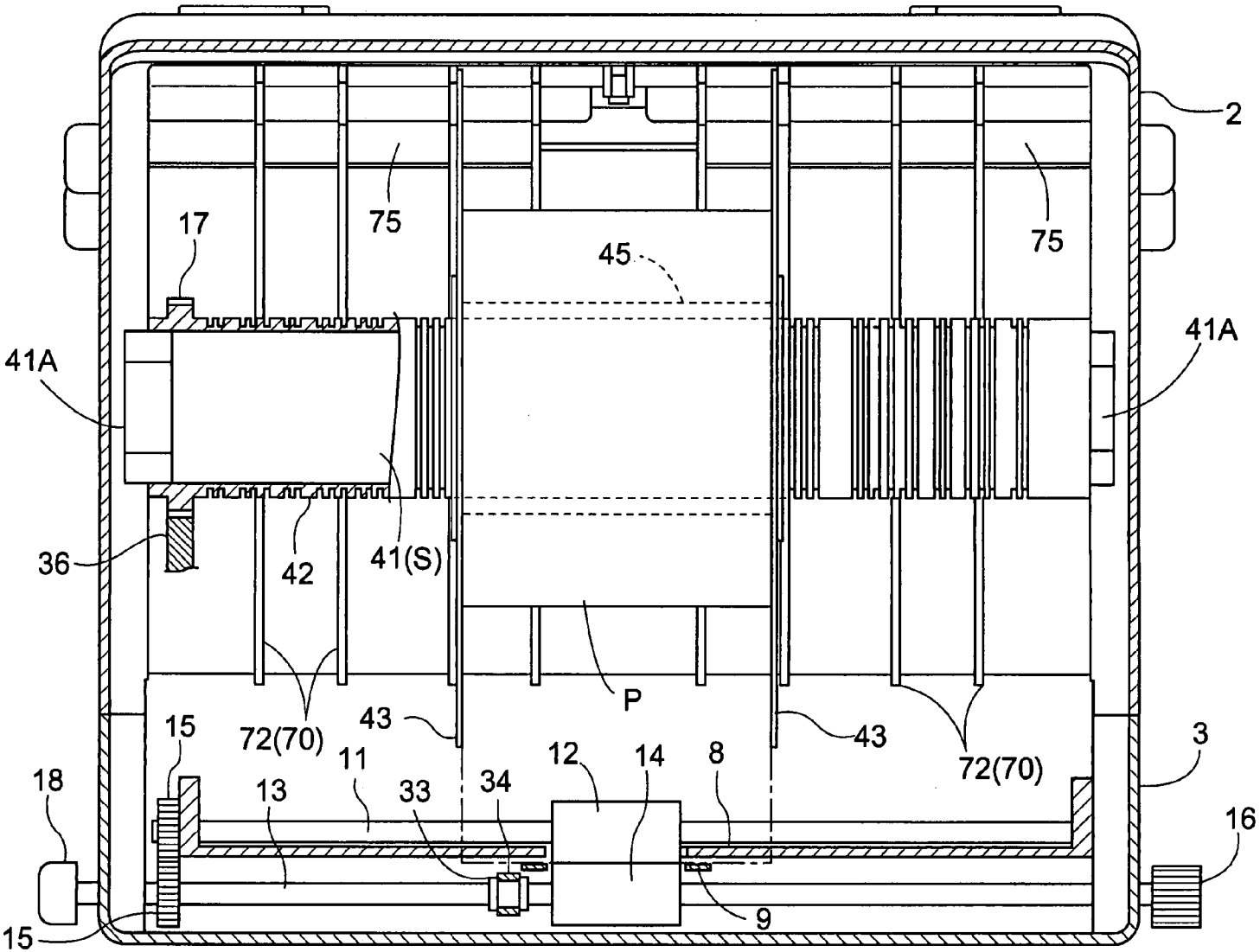
FIG. 6 is a front view in section of the paper magazine.

The gear transmission section TG includes a set of four gears 36 from a gear directly coupled with the transmission shaft 23 to the final gear, which gears 36 are rotatably supported to a plate 37. Further, as shown in FIGS. 6 and 8, the shaft portion S includes a cylindrical rotational shaft portion 42 rotatably mounted on a main shaft portion 41 and a pair of position regulating discs 43 to come into contact with opposed lateral face of the print paper roll S supported on the rotational shaft portion 42. In each of opposed terminal ends of the main shaft portion 41, there is formed a retaining portion 41A having a hexagonal cross section to be clamped and retained between the main box member 2 and the auxiliary box member 3, and the ring gear 17 is mounted on an end of the rotational shaft portion 42.

According to the above-described construction of the transmission control section TC in operation, when the print paper P is to be delivered by the force transmitted to the input gear 16, a tension corresponding to the torque set in the slip transmission mechanism 32 is applied to the print paper portion P located between the shaft portion S and the main and auxiliary rollers 12, 14. As a result, there occurs no trouble of slackness in the print paper P inside the paper magazine. Further, when the rotation of the gear assembly G is stopped as in the case of the suspension or stop of the delivering operation, the slip transmission mechanism 32 immediately applies the braking force to the transmission shaft 23, thereby to avoid the trouble of continued rotational delivery of the print paper portion from the print paper roll P due to the dynamic inertia.

Further, when the shaft portion S tends to be rotated in the direction for rewinding the print paper P as is the case when an external shock is applied to the paper magazine M during its transport or the magazine M is rocked, the transmission shaft 23 is rotated in this direction, whereby the second one-way clutch 29 transmits the rotational force of the transmission shaft 23 to the third gear 30. Further, this rotational force is transmitted via the first gear 24 to the friction applying mechanism 27 and the first one-way clutch 28. As a result, the first one-way clutch 28 reaches its constricted condition to cause the frictional applying mechanism 27 to apply its frictional braking force against the rotation of the transmission shaft 23. This prevents inconvenience of the print paper P being inadvertently drawn toward the shaft portion S from the position of the main roller 12 and the auxiliary roller 14. And, when the print paper P is to be rewound back into the paper magazine for the purpose of e.g. replacing the paper magazine in the photographic printer, by transmitting the force to the input gear 16, the end of the print paper P can be rewound into the paper magazine although the frictional force is applied thereto from the friction applying mechanism 27.

This paper magazine M is configured for storing the print paper P in the form of a roll therein with the core 45 of the paper P being mounted on the rotational shaft portion 42 of the shaft portion S. For using print papers P of differing widths, the opposed pair of position regulating discs 43 mounted on the rotational shaft portion 42 are adjusted in their positions relative to each other and between the main wall face 8 and the auxiliary wall face 9 according to a particular width of the print paper P to be used.

Figure 12:
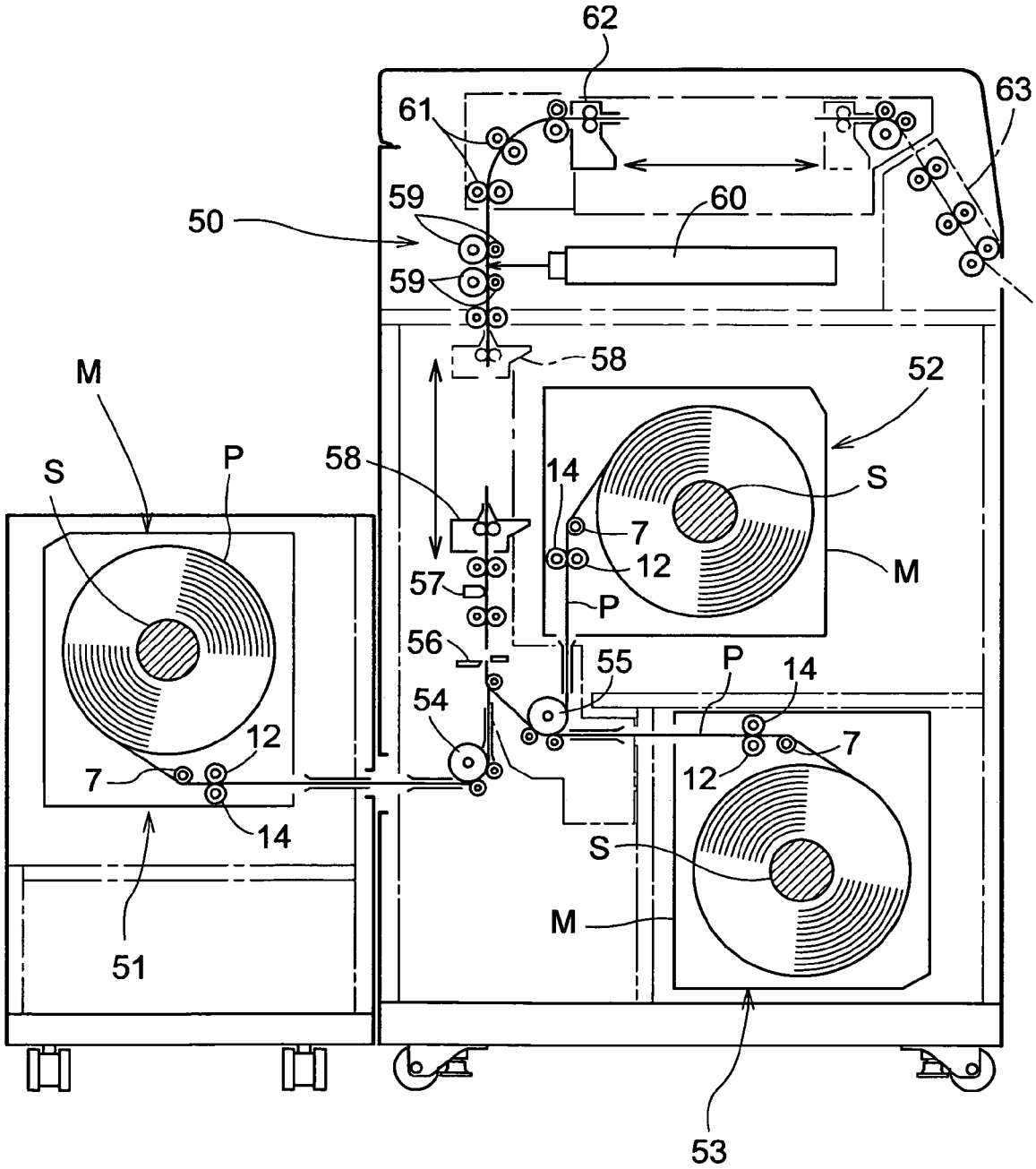
FIG. 12 is a section showing arrangement of the paper magazine at an exposing section of a photographic printer.

The print magazine M can be set to the photographic printer as illustrated in FIG. 12 for example. This photographic printer allows the paper magazine M to be set under its exposing section 50 to a first storage section 51, a second storage section 52 and a third storage section 53, respectively. When the paper magazines M are set to the first storage section 51 and the third storage section 53, the postures of these paper magazines M are set so as to deliver the print paper P through the opening 6 in the horizontal direction. Whereas, when the paper magazine M is set to the second storage section 52, the posture of this magazine is set so as to deliver the print paper P through the opening 6 in the perpendicular downward direction.

Further, when three paper magazines M are set to this photographic printer, the print papers of these three paper magazines M are fed from a first advance roller 54 or a second advance roller 56 to a cutter 56. Next, when each paper is cut by the cuter 56 into a print size, and on the back face of this print paper P cut into the print size by the cutter 56, a dot-matrix type printing head 57 effects printing of necessary information. Thereafter, as the print paper P is transported upward by a clamping transport member 58 to be transferred to a clamping type exposure transport roller 59 of the exposing section 50. And, on the print paper P being transported by this exposure transporting roller 59, an exposing operation is effected by scanning a laser beam from an exposure engine 60 on the paper. Then, the exposed print paper P is changed in its transporting direction to the horizontal direction by means of a plurality of transport rollers 61. Further, the paper is sorted to one of two arrays of paths by means of a pair of chuckers 62 constituting a sorting unit and the paper is fed from a transport unit 63 having a plurality of clamp rollers to a developing section (not shown). These together constitute a transporting system for the print paper P.

Further, with this photographic printer, the postures of the paper magazine M set to the printer are different from each other when these are set to the first, second and third storage sections 51, 52, 53. More particularly, when the paper magazine is set to the first storage section 51, the opening 6 of the magazine is located at a lower position for delivering the print paper P in the horizontal direction therethrough. When the magazine is set to the second storage section 52, the opening thereof is located at a lower portion of the magazine for delivering the print paper P downwards therethrough. When the magazine is set to the third storage section 53, the opening 6 thereof is located at an upper portion of the magazine for delivering the print paper P in the horizontal direction.

Figure 9:
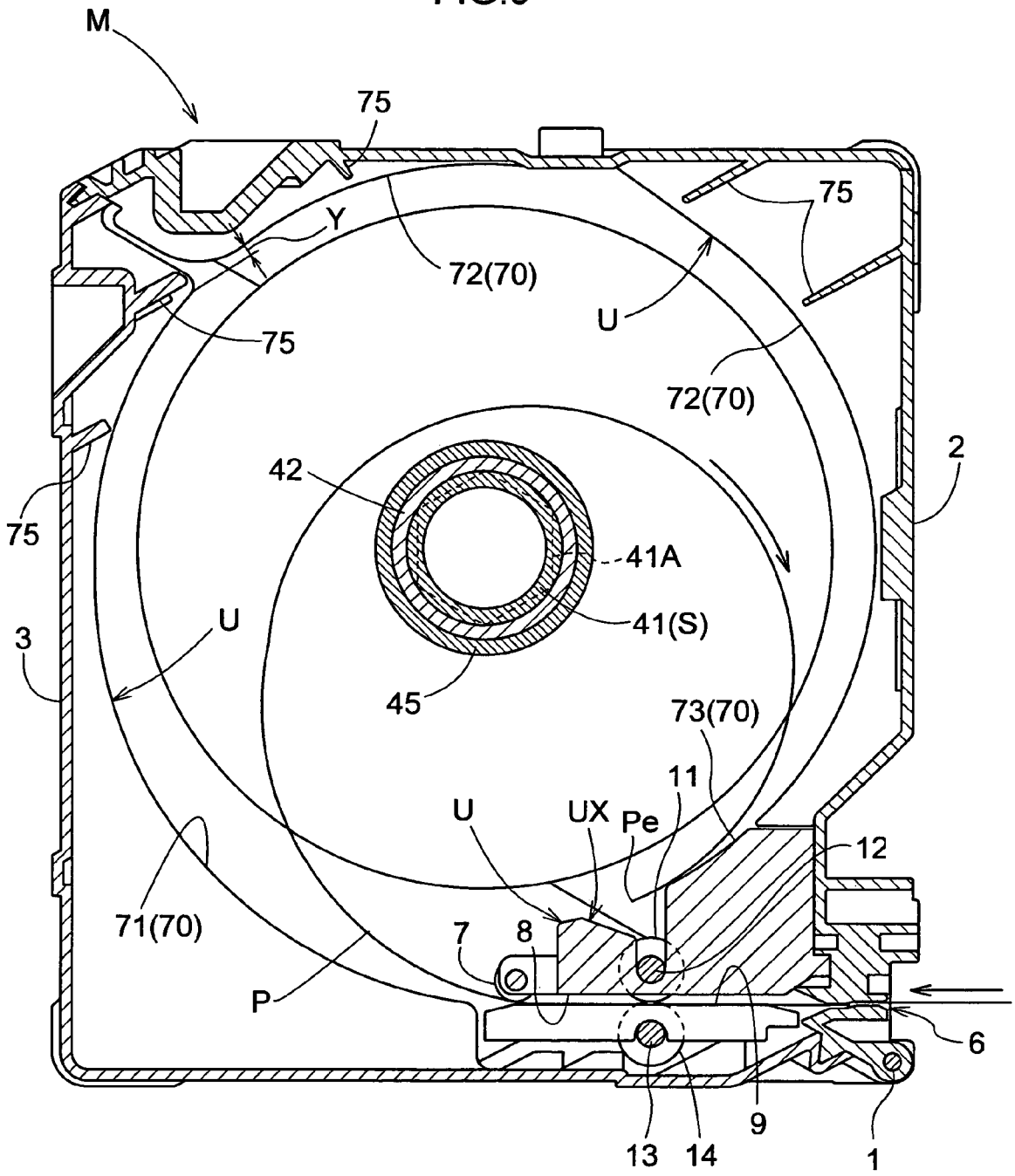
FIG. 9 is a front view in vertical section showing a posture of the paper magazine having rewound a print paper therein.
Figure 10:
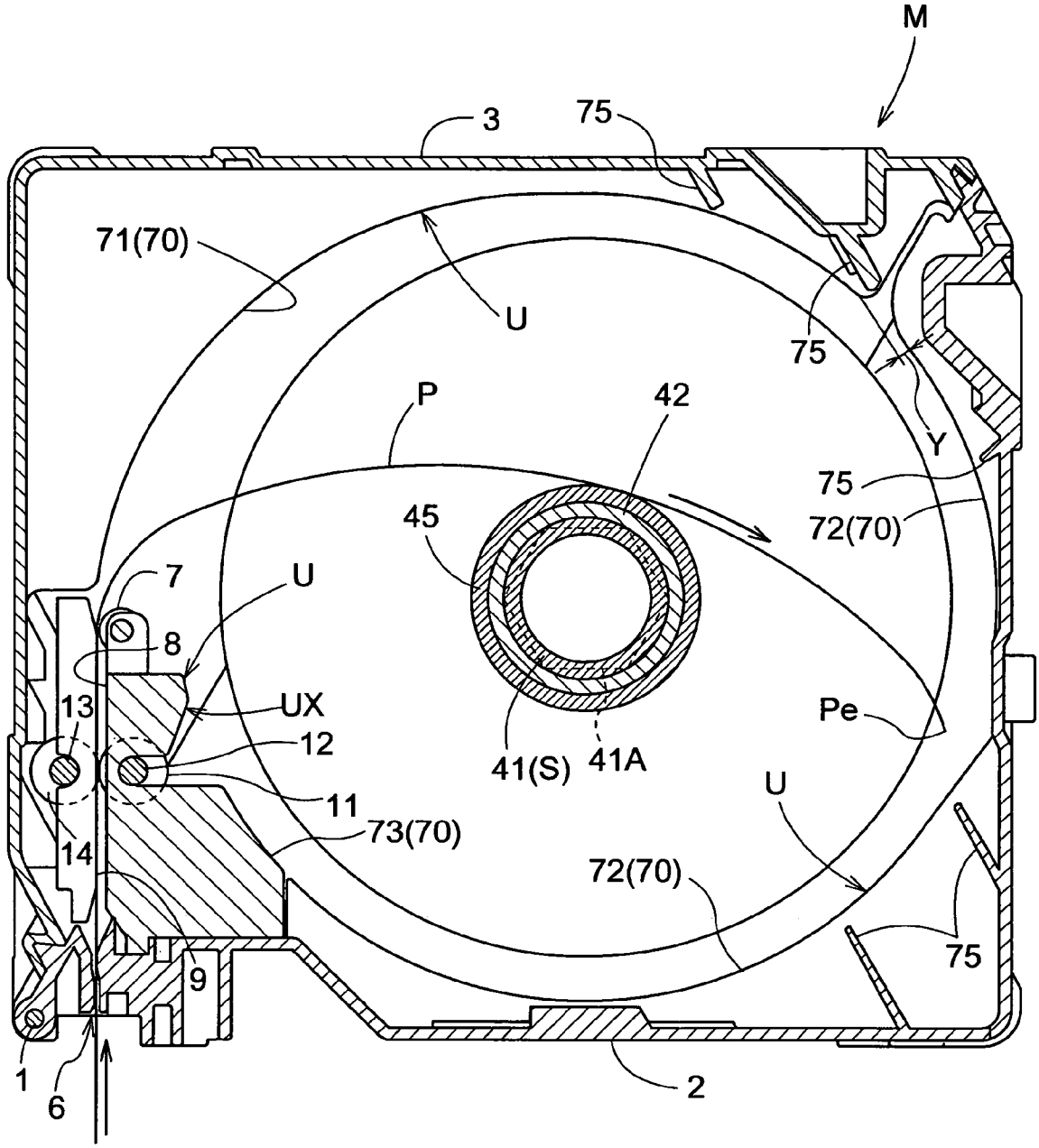
FIG. 10 is a front view in vertical section showing another posture of the paper magazine having rewound a print paper therein.
Figure 11:
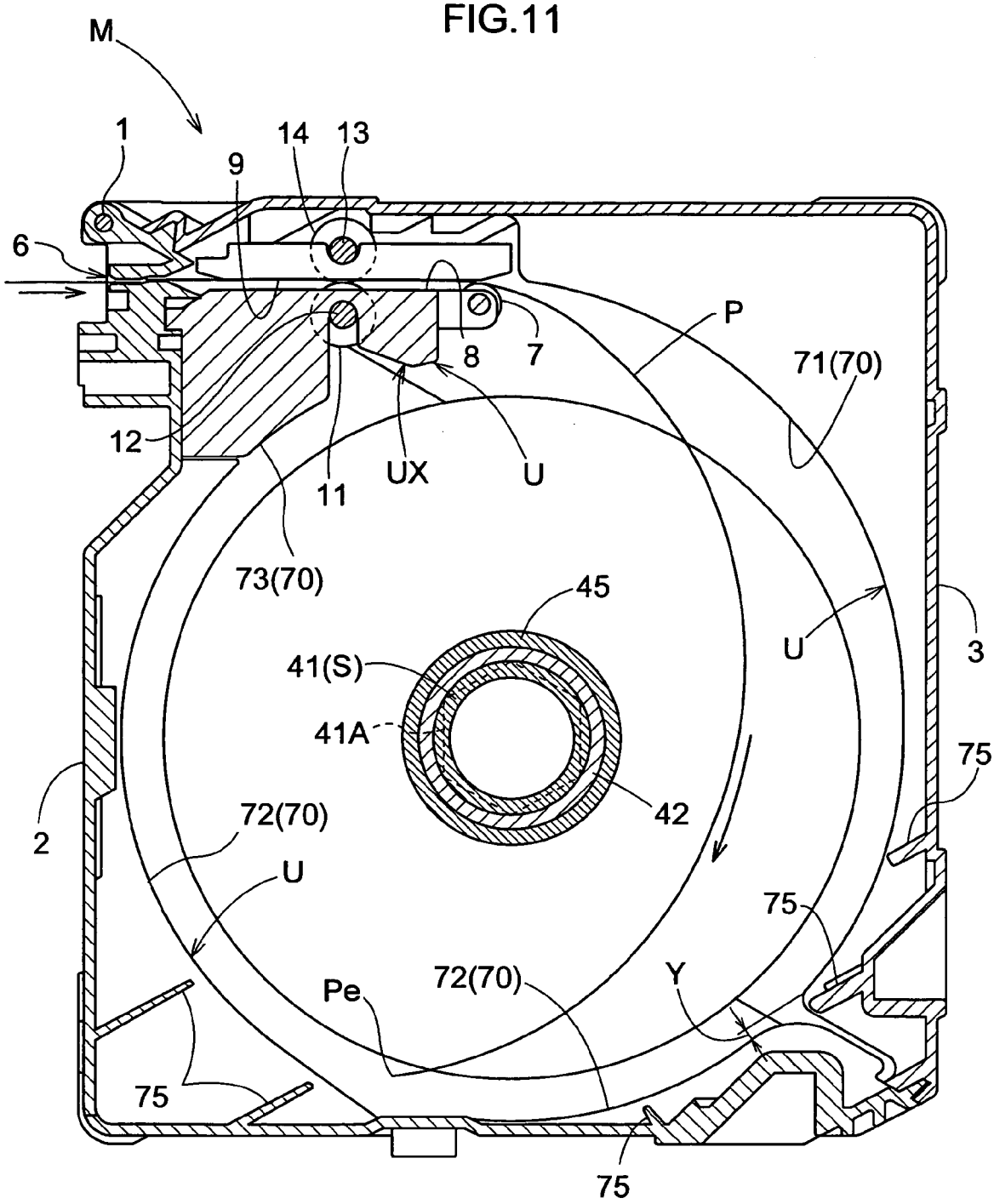
FIG. 11 is a front view in vertical section showing still another posture of the paper magazine having rewound a print paper therein.

The paper magazine M of the invention can be set to the three kinds of postures described above. To whichever posture the magazine may be set, as shown in FIG. 9, FIG. 10 and FIG. 11, if the print paper P is rewound after its terminal end Pe has been detached from the core 45, the terminal end Pe of the print paper P assumes a hanging-down posture by the weight of its own inside the frame. Then, according to the paper magazine M of the present invention, whichever the magazine M may be set to the above-described three kinds of posture, undesired bending or damage of the terminal end Pe assuming the hanging-down posture is avoided by means of a guide member 70 (generically representing first, second and third guides 71, 72, 73 to be described later) formed inside the frame and the paper can be smoothly rewound back into the paper magazine M. Incidentally, the print paper M postures illustrated in FIG. 9, FIG. 10 and FIG. 11 are the postures of the magazine when stored to the first storage section 51, the second storage section 52 and the third storage section 53 shown in FIG. 12, respectively. Further, the guide member 70 is provided in the form of a plurality of ribs oriented normal to the surface of the print paper P.

More particularly, as shown in FIG. 8 and FIG. 9, the guide member 70 consists essentially of the first guide 71 formed on the inner face of the auxiliary box member 3, the second guide 72 formed on the inner face the main box member 3, and the third guide 73 formed on the main wall face 8. These first, second and third guides 71, 72, 73 are configured to form guide faces U in the form as a whole of an approximate circle about the axis of the shaft portion S. Incidentally, this concept of "approximate circle" about the axis of the shaft portion S formed by the guide faces U means the shape of the guide faces U as a whole being circle or near circle, with the concept being inclusive of not only a true circle, but also a slightly deformed circle, a circle including a straight portion in the guide face U, a discontinuous circle formed by a discontinuous guide face U, etc.

Further, at a portion where the first guide 71 and the second guide 72 are adjacent each other, this portion is to be separated when the frame is opened. For this reason, the distance from the axis of the guide face U of either the guide 71 or 72 located on the downstream side when the print paper P is rewound is set longer than the distance from the axis of the guide face U of the guide located on the upstream side, thereby to form a stepped portion Y. As a result, when the print paper P is rewound, the terminal end Pe of the print paper P can be fed smoothly, without inviting the inconvenience of the terminal end Pe being entrapped between the first guide 71 and the second guide 72.

Further, since a groove-like gap needed for mounting the main shaft member 11 is formed between the second guide 72 and the third guide 73, there is the possibility of the terminal end Pe of the print paper P being entrapped therein in the course of the rewinding operation of the print paper P. Therefore, in order to allow the terminal end Pe of the print paper P entrapped into this gap to be discharged toward the shaft portion S, of the guide face U of the third guide 73, a guide face portion UX (an example of an "inclined portion") adjacent the gap is formed with an inclination for discharging the terminal end Pe of the print paper P toward the shaft portion S. That is, since the guide face U includes the inclined guide face portion UX for coming into contact with and applying a force to the terminal end Pe of the paper P in the direction toward the shaft portion S during the paper rewinding operation, the terminal end Pe of the print paper P can be discharged to the inner side of the paper magazine M.

The guide member 70 in the form of ribs are provided in plurality and formed with a predetermined distance therebetween. Yet, each rib, i.e. the guide member 70, does not have very high strength. Rather, a plurality of reinforcing frames 75 oriented substantially normal to the faces of the guide members 70 are provided for interconnecting these guide members 70 for reinforcement of each guide member 70.

As described above, according to the present invention, under whichever of the three postures the paper magazine M may be employed and even when the print paper P is rewound into the frame after the print paper P has been used until detachment of its terminal end Pe from the core 45, this terminal end Pe assumes a hanging-down posture inside the magazine under the effect of gravity. However, as the guide member 70 comes into contact with this hanging-down terminal end Pe of the print paper P and feeds, i.e. rewinds, this end Pe smoothly. Therefore, as compared with the construction adapted for causing the terminal end Pe of the print paper P to directly contact the inner face of the frame, the rewinding operation of the print paper P can proceed smoothly, with avoiding bending of the print paper P or other damage thereto.

Other Embodiments

The present invention may be alternatively embodied as described below.

(1) The guide member may be provided as a component formed separately from the frame to be attached to the inner face of the frame. In this case of the guide member formed as a separate component to be attached to the frame, there is achieved an advantage of improvement of an existing paper magazine without such guide member being made possible.

(2) The guide member may comprise a plurality of free rollers mounted inside frame, the rollers being rotatable when contacting the print paper. In this case of the guide member being provided as a plurality of rollers, there is achieved the advantage of allowing smooth rewinding of the print paper P without applying any strong resistance thereto.

(3) In the foregoing embodiment, a rotational force is applied to the shaft portion for rewinding the print paper P. Instead, for the same purpose rollers or the like contacting the outer periphery of the print paper roll may be driven, as described in the Japanese Patent Application "Kokai" No. 2001-92031 described hereinbefore.

The invention claimed is:

1. A paper magazine comprising:

a shaft portion for rotatably supporting a paper roll inside a box frame including two guide frame members connected to be pivotally opened/closed about a support shaft, said shaft portion being disposed parallel with an axis of the support shaft;

a paper transporting system configured for pinching a paper drawn out of the paper roll supported on the shaft portion by transport rollers and delivering the paper through an opening formed in the frame;

a transmission mechanism for transmitting a forward drive force and a reverse drive force to the transport rollers to effect the delivery and rewinding of the paper through the opening; and a fixed guide member provided on an inner wall face of the box frame disposed at a lower portion inside the paper magazine, said fixed guide member being configured for contacting a terminal end of the paper and guiding the paper in a rewinding direction when the paper assumes a hanging down posture in a paper rewinding operation effected after detachment of the terminal end of the paper from the shaft portion as a result of a paper delivering operation effected with the paper magazine being set under a predetermined posture; and wherein said fixed guide member is disposed at a portion where said two guide frame members are adjacent to each other; and wherein a distance from said axis to a guide face of one of said guide frame members located on the downstream side in the rewinding direction is set longer than a distance from said axis to a guide face of the other guide frame member located on the upstream side in the rewinding direction, thereby providing a stepped portion.

2. The paper magazine of claim 1, wherein said predetermined posture includes at least one of the following: a posture for delivering the paper through the opening in a horizontal direction and a posture for delivering the paper through the opening in a perpendicularly downward direction.

3. The paper magazine of claim 1, wherein said guide member is provided as a member formed inside the frame and having a guide face which is substantially circular about an axis of the shaft portion as seen along the axis.

4. The paper magazine of claim 3, wherein said guide member is formed as a plurality of ribs formed integral with the inner wall face of the frame and oriented substantially normal to a surface of the paper.

5. The paper magazine of claim 1, wherein said guide member includes an inclined portion for coming into contact with and applying a force to said terminal end of the paper in a direction toward said shaft portion during the paper rewinding operation.

* * * * *